US008777637B2

(12) United States Patent
Sun et al.

(10) Patent No.: US 8,777,637 B2
(45) Date of Patent: Jul. 15, 2014

(54) CONNECTOR FOR CONNECTING A COAXIAL CABLE AND A CIRCUIT BOARD AND RELATED TRANSMISSION INTERFACE AS WELL AS ASSEMBLY METHOD THEREWITH

(75) Inventors: Rong-Cheng Sun, New Taipei (TW); Cheng-Shing Liu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 0 days.

(21) Appl. No.: 13/545,005

(22) Filed: Jul. 10, 2012

(65) Prior Publication Data

US 2013/0078824 A1 Mar. 28, 2013

(30) Foreign Application Priority Data

Sep. 27, 2011 (TW) ..... 100134777 A

(51) Int. Cl.
*H01R 12/00* (2006.01)

(52) U.S. Cl.
USPC ..... 439/63

(58) Field of Classification Search
USPC ..... 439/581, 63, 877
See application file for complete search history.

(56) References Cited

U.S. PATENT DOCUMENTS

| | | | | |
|---|---|---|---|---|
| 3,141,924 | A * | 7/1964 | Forney, Jr. | 174/75 C |
| 3,742,425 | A * | 6/1973 | Peltola et al. | 439/63 |
| 3,743,748 | A * | 7/1973 | Reeder | 174/75 C |
| 3,980,382 | A * | 9/1976 | Reeder | 439/581 |
| 5,246,384 | A * | 9/1993 | Sato | 439/585 |
| 6,372,990 | B1 * | 4/2002 | Saito et al. | 174/74 R |

* cited by examiner

*Primary Examiner* — Phuong Dinh
(74) *Attorney, Agent, or Firm* — Winston Hsu; Scott Margo

(57) ABSTRACT

A connector for connecting a coaxial cable and a circuit board is disclosed. The connector includes a main body, a first holding portion, a second holding portion and a fixing structure. The first holding portion extends from a first end portion of the main body for holding a first insulation layer of the coaxial cable. The second holding portion extends from the main body in a position located between a second end portion opposite to the first end portion and the first holding portion for holding a braid layer of the coaxial cable. The fixing structure extends from the second end portion of the main body in a direction away from the second holding portion for disposing through at least one hole on the circuit board, so as to fix the coaxial cable on the circuit board.

18 Claims, 9 Drawing Sheets

CONNECTOR FOR CONNECTING A COAXIAL CABLE AND A CIRCUIT BOARD AND RELATED TRANSMISSION INTERFACE AS WELL AS ASSEMBLY METHOD THEREWITH

BACKGROUND OF THE INVENTION

1. Field of the Invention

The present invention relates to a connector, a related transmission interface and an assembly method therewith, and more particularly, to a connector for connecting a coaxial cable and a circuit board, a related transmission interface and an assembly method therewith.

2. Description of the Prior Art

Recently, with the development of technology, data transmitted between a circuit board and an external component, such as an antenna of an electronic device, has been increasing. Further, signal frequencies for communicating the circuit board and the external component are getting higher and higher as well. Generally speaking, a coaxial cable is often used as an interface for signal transmission between the circuit board and the external component. A conventional assembly of the coaxial cable and the circuit board is that two connectors are respectively installed on the coaxial cable and the circuit board in a termination technology, such as a crimping technology, a surface mount technology (SMT), and then the connector installed on the coaxial cable is used for plugging into the connector installed on the circuit board.

However, since there are two connectors required in the aforesaid assembly, it is hard to decrease material cost of manufacture. In addition, the conventional solution is to install the two connectors respectively on the corresponding coaxial cable and the circuit board, and hence it requires two processes respectively for assembling the connector with the coaxial cable and for assembling the connector on the circuit board. As a result, it is not only hard to decrease the material cost but also requires extra labors for the conventional assembly, resulting in disadvantages of manufacture.

SUMMARY OF THE INVENTION

Thus, the present invention provides a connector for connecting a coaxial cable and a circuit board, a related transmission interface and an assembly method therewith for solving above drawbacks.

According to the claimed invention, a connector for connecting a coaxial cable and a circuit board includes a main body, a first holding portion, a second holding portion and a fixing structure. The first holding portion extends from a first end portion of the main body for holding a first insulation layer of the coaxial cable. The second holding portion extends from the main body in a position located between a second end portion opposite to the first end portion and the first holding portion for holding a braid layer of the coaxial cable. The fixing structure extends from the second end portion of the main body in a direction away from the second holding portion for disposing through at least one hole on the circuit board, so as to fix the coaxial cable on the circuit board.

According to the claimed invention, the fixing structure includes a first pin and a second pin. The first pin extends in the direction away from the second holding portion and is located on a side of the main body. The second pin extends in the direction away from the second holding portion and is located on another side of the main body. The at least one hole on the circuit board includes a first through hole and a second through hole. The first pin and the second pin are respectively disposed through the first through hole and the second through hole on the circuit board, so as to fix the coaxial cable on the circuit board.

According to the claimed invention, the first holding portion has a first width, the second holding portion has a second width, and the second width is substantially identical to a width of the braid layer.

According to the claimed invention, the first width is substantially identical to the second width.

According to the claimed invention, the connector includes a third holding portion. The third holding portion extends from the second end portion of the main body for holding a second insulation layer of the coaxial cable, wherein the third holding portion has a third width, and the third width is substantially identical to a width of the second insulation layer.

According to the claimed invention, the transmission interface includes a circuit board, a coaxial cable, a female connector and a connector. At least one hole is formed on the circuit board. The coaxial cable is disposed on the circuit board and includes a first insulation layer, a braid layer, a second insulation layer and a conductor. The female connector is connected to an end of the coaxial cable. The connector is connected to another end of the coaxial cable and includes a main body, a first holding portion, a second holding portion and a fixing structure. The first holding portion extends from a first end portion of the main body for holding the first insulation layer of the coaxial cable. The second holding portion extends from the main body in a position located between a second end portion opposite to the first end portion and the first holding portion for holding the braid layer of the coaxial cable. The fixing structure extends from the second end portion of the main body in a direction away from the second holding portion for disposing through at least one hole on the circuit board, so as to fix the coaxial cable on the circuit board.

According to the claimed invention, a third hole is formed on the circuit board, and the conductor of the coaxial cable is disposed through the third through hole when the first pin and the second pin respectively dispose through the first through hole and the second through hole.

According to the claimed invention, a method for assembling a coaxial cable on a circuit board by a connector includes forming at least one hole on the circuit board; fixing an end of the coaxial cable with the connector; disposing a fixing structure of the connector through the at least one hole on the circuit board; and fixing the fixing structure on the circuit board.

According to the claimed invention, the fixing structure of the connector is disposed through the at least one hole on the circuit board after the end of the coaxial cable is fixed with the connector.

According to the claimed invention, the end of the coaxial cable is fixed with the connector after the fixing structure of the connector is disposed through the at least one hole on the circuit board.

According to the claimed invention, fixing the end of the coaxial cable with the connector includes utilizing a first holding portion of the connector to hold a first insulation layer of the coaxial cable; utilizing a second holding portion of the connector to hold a braid layer of the coaxial cable; and utilizing a third holding portion of the connector to hold a second insulation layer of the coaxial cable.

According to the claimed invention, fixing the end of the coaxial cable and the connector includes utilizing a first holding portion of the connector to hold a first insulation layer of the coaxial cable; utilizing a second holding portion of the connector to hold a braid layer of the coaxial cable; and utilizing a third holding portion of the connector to hold a second insulation layer of the coaxial cable.

According to the claimed invention, forming the at least one hole on the circuit board includes forming a first through hole and a second through hole on the circuit board, and disposing the fixing structure of the connector through the at least one hole on the circuit board includes disposing a first pin and a second pin of the fixing structure through the first through hole and the second through hole, respectively.

According to the claimed invention, fixing the fixing structure on the circuit board includes fixing the first pin and the second pin on the circuit board by using surface mounting technology (SMT), respectively.

According to the claimed invention, forming the at least one hole on the circuit board further includes forming a third through hole on the circuit board, and the method further includes disposing a conductor of the coaxial cable through the third through hole.

In summary, the present invention utilizes the first holding portion, the second holding portion and the third holding portion to respectively hold the first insulation layer, the braid layer and the second insulation layer of the coaxial cable, so as to fix the connector with the end of the coaxial cable. Furthermore, the first pin and the second pin of the connector as well as the conductor of the coaxial cable can be respectively disposed through the first through hole, the second through hole and the third through hole on the circuit board, and then the first pin, the second pin and the conductor can be fixed on the circuit board by using surface mounting technology. In such a manner, the present invention can utilize a single connector to connect the coaxial cable on the circuit board, so as to decrease material cost of manufacture. In addition, when the coaxial cable is fixed with the circuit board by the connector, the end of the coaxial cable is to be fixed with the connector after the fixing structure of the connector is disposed through the at least one hole on the circuit board. Alternatively, the fixing structure of the connector also can to be disposed through the at least one hole on the circuit board after the end of the coaxial cable is fixed with the connector. Since the connector is capable of assembling with the coaxial cable and the circuit board simultaneously, it facilitates to save extra labors for assembly and results in decrease of manufacture cost.

These and other objectives of the present invention will no doubt become obvious to those of ordinary skill in the art after reading the following detailed description of the embodiment that is illustrated in the various figures and drawings.

DETAILED DESCRIPTION

Figure 1:
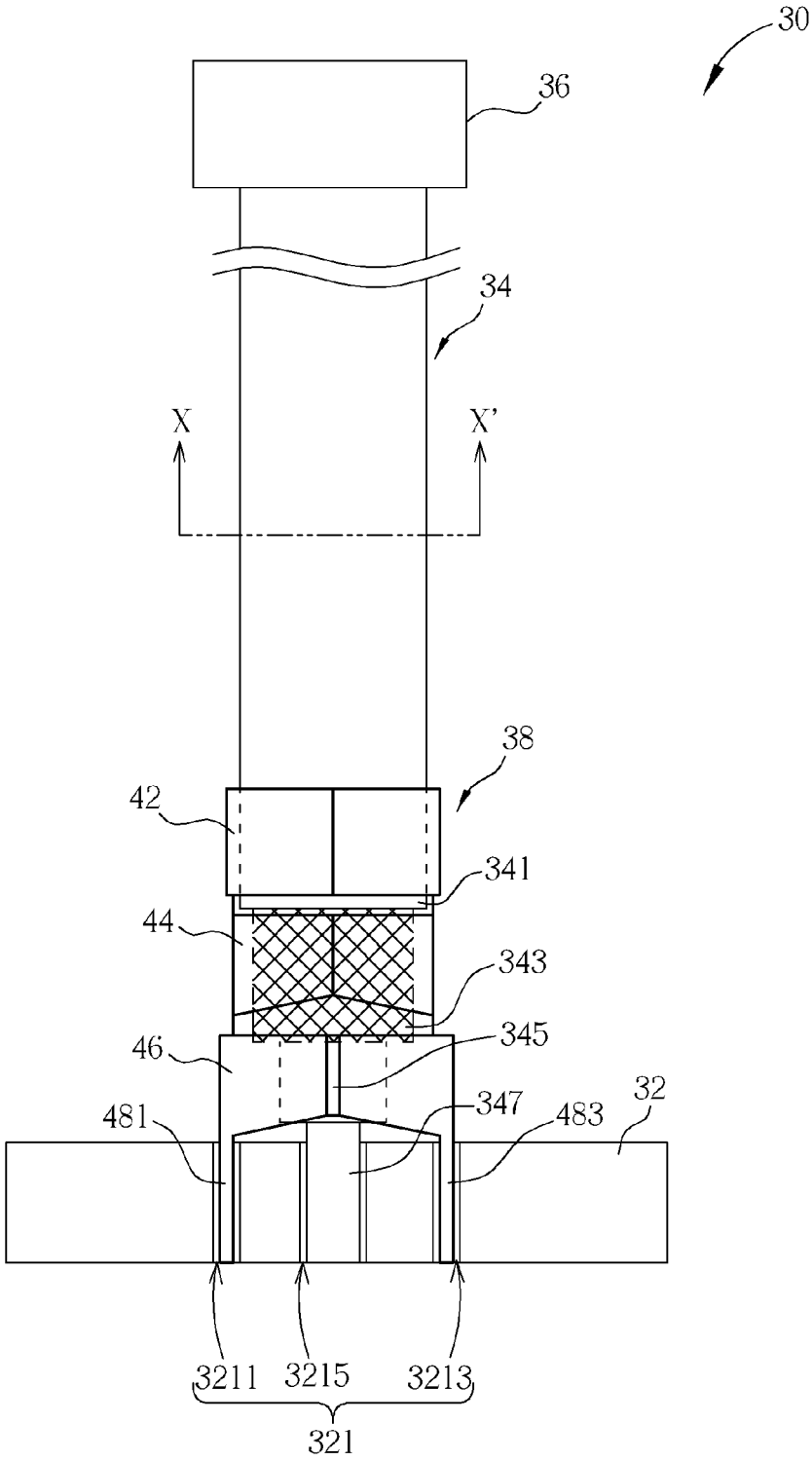
FIG. 1 is a diagram of a transmission interface according to an embodiment of the present invention.

Please refer to FIG. 1. FIG. 1 is a diagram of a transmission interface 30 according to an embodiment of the present invention. As shown in FIG. 1, the transmission interface 30 includes a circuit board 32, a coaxial cable 34, a female connector 36 and a connector 38. The female connector 36 is connected to an end of the coaxial cable 34, and the connector 38 is connected to another end of the coaxial cable 34 for connecting the coaxial cable 34 and the circuit board 32. Accordingly, signals received by the female connector 36 can be transmitted to the circuit board 32 sequentially via the coaxial cable 34 and the connector 38. Alternatively, signals generated by the circuit board 32 can be transmitted to the female connector 36 sequentially via the connector 38 and the coaxial cable 34, and then the signals are transmitted by an electronic component, such as an antenna, connected to the female connector 36. As a result, an electronic device with the transmission interface 30 of the present invention can communicate with other external electronic devices. In this embodiment, the female connector 36 can preferably be a connector which is adapted to a cable, such as an IPEX connector. In addition, the transmission interface 30 can be preferably, but not limited to, implemented in a notebook computer. The transmission interface 30 can be implemented in a mobile phone as well. In other words, 3C electronic devices with communication function are within the scope of the present invention.

Figure 2:
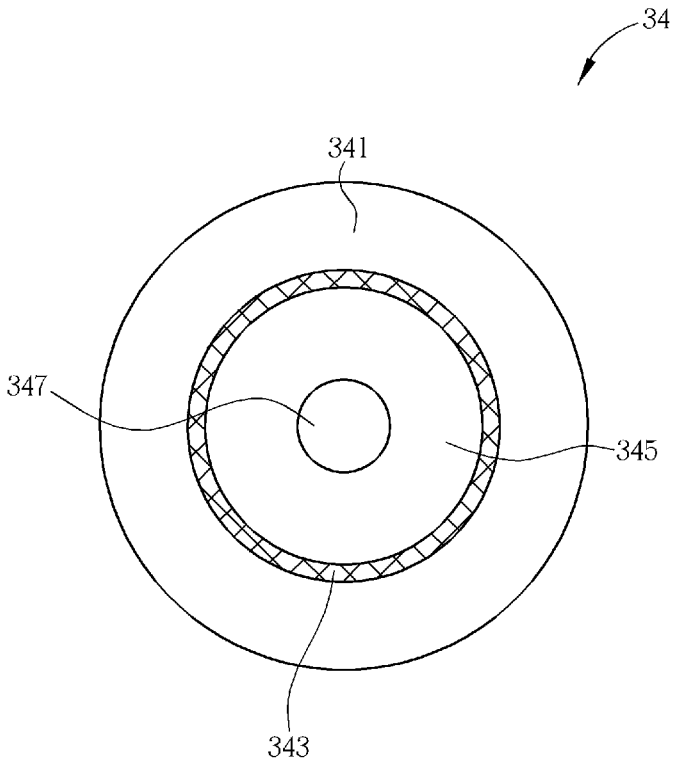
FIG. 2 is a cross-section diagram of a coaxial cable taken along a cross-section line X-X' in FIG. 1.

Please refer to FIG. 2. FIG. 2 is a cross-section diagram of the coaxial cable 34 taken along a cross-section line X-X' in FIG. 1. As shown in FIG. 2, the coaxial cable 34 includes a first insulation layer 341, a braid layer 343, a second insulation layer 345 and a conductor 347. The first insulation layer 341, the braid layer 343, the second insulation layer 345 and the conductor 347 are arranged concentrically and inwardly in sequence. The conductor 347 is used for transmitting the signals. In practical application, the conductor 347 can be preferably a signal wire with resistance of 50 ohms. Furthermore, the braid layer 343 is used for absorbing external electronic magnetic wave, so as to reduce electronic magnetic interference (EMI). The second insulation layer 345 is used for insulating the conductor 347 from the braid layer 343, such that the conductor 347 is capable of transmitting the signals stably and exactly. The first insulation layer 341 covers the braid layer 343 for protecting the braid layer 343. In practical application, the conductor 347 and the braid layer 343 of the coaxial cable 34 can be made of metal materials, and the second insulation layer 345 and the first insulation layer 341 can be made of insulating materials, such as plastic materials.

Figure 3:
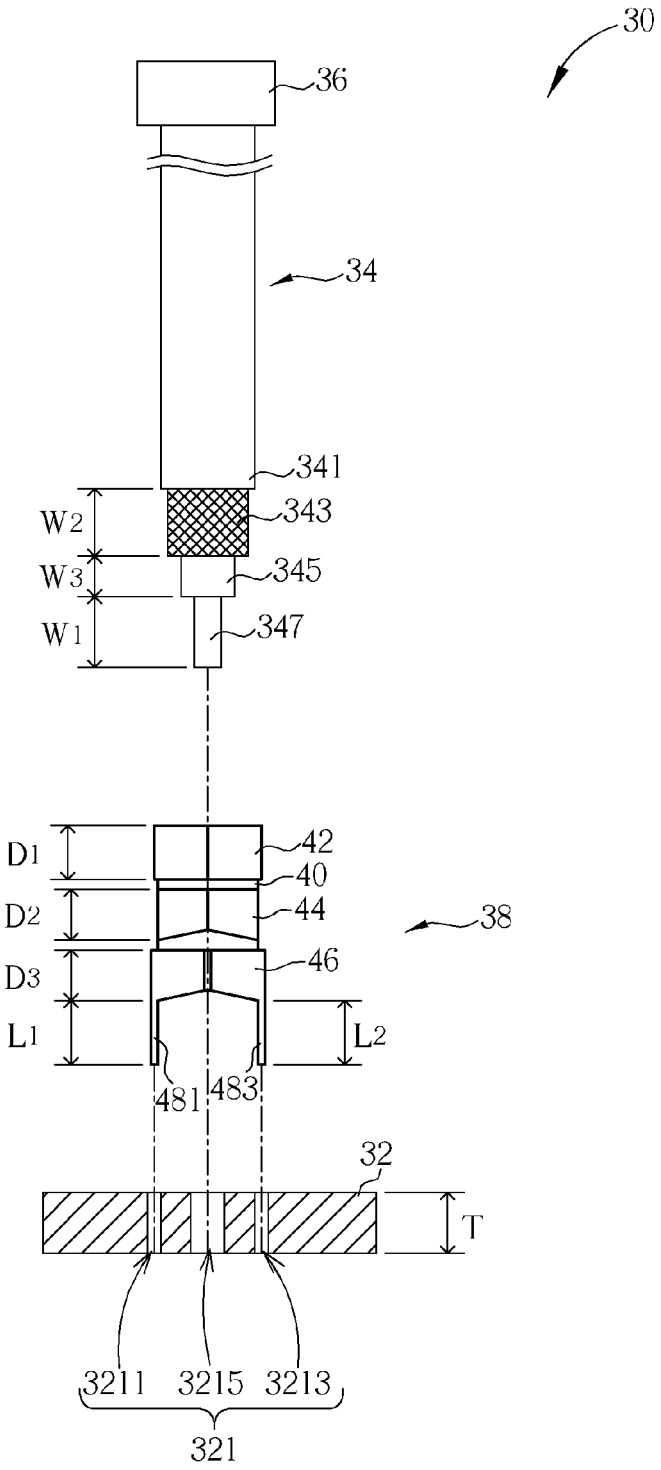
FIG. 3 is an exploded diagram of the transmission interface according to the embodiment of the present invention.
Figure 4:
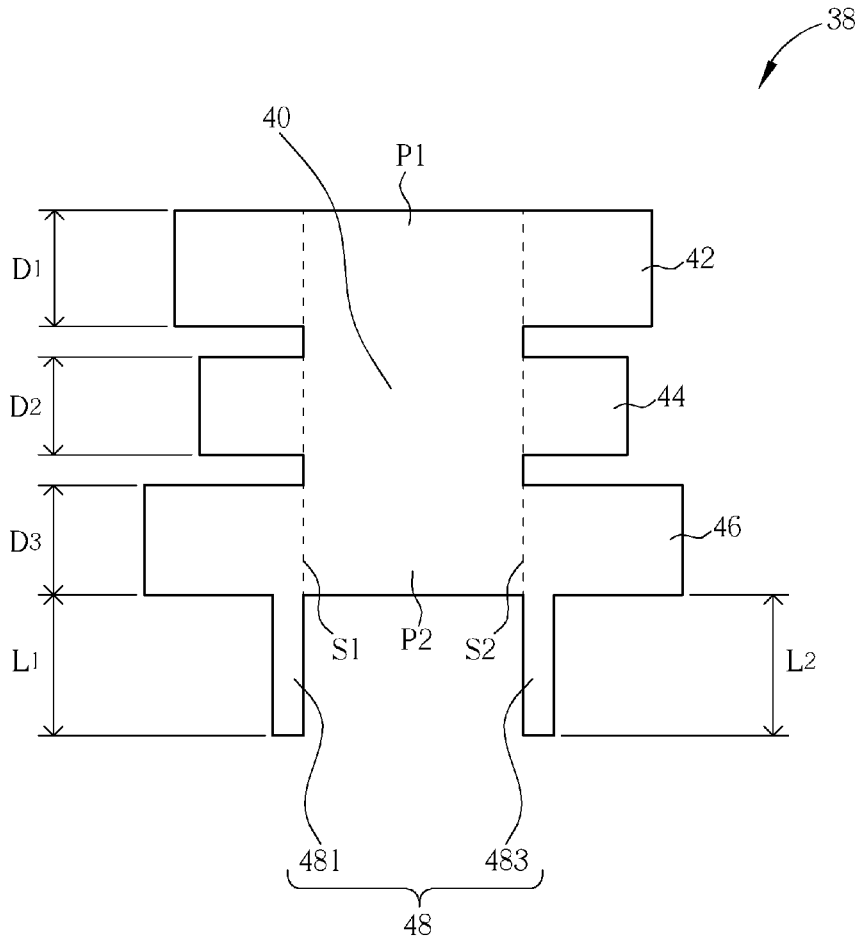
FIG. 4 is a diagram of a connector in an expanded status according to the embodiment of the present invention.

Please refer to FIG. 1 to FIG. 4. FIG. 3 is an exploded diagram of the transmission interface 30 according to the embodiment of the present invention. FIG. 4 is a diagram of the connector 38 in an expanded status according to the embodiment of the present invention. As shown in FIG. 1 to FIG. 4, at least one hole 321 is formed on the circuit board 32, and the connector 38 includes a main body 40, a first holding portion 42, a second holding portion 44, a third holding portion 46 and a fixing structure 48. The first holding portion 42 extends from a first end portion P1 of the main body 40. The second holding portion 44 extends from the main body 40 in a position located between a second end portion P2 opposite to the first end portion P1 and the first end portion P1. The third holding portion 46 extends from the second end portion P2 of the main body 40. Furthermore, the fixing structure 48 extends from the second end portion P2 of the main body 40 in a direction away from the second holding portion 44. In other words, the first holding portion 42, the second holding portion 44 and the third holding portion 46 are located in sequence on the main body 40 in a direction from the first end portion P1 to the second end portion P2, and the fixing structure 48 extends outwardly from the second end portion P2 of the main body 40.

It should be noticed that the end of the coaxial cable 34 can be processed in advance when the connector 38 is desired to be connected to the coaxial cable 34, such that the conductor 347, the second insulation layer 345 and the braid layer 343 are exposed in sequence, the exposed conductor 347 has a width W1, the exposed braid layer 343 has a width W2 and the exposed second insulation layer 345 has a width W3, as shown in FIG. 3. When the connector 38 is connected to the coaxial cable 34 in a termination technology, the main body 40, the first holding portion 42, the second holding portion 44 and the third holding portion 46 can cover the end of the coaxial cable 34 in a crimping manner. In the meanwhile, the first holding portion 42, the second holding portion 44 and the third holding portion 46 of the connector 38 can be respectively used for holding the first insulation layer 341, the braid layer 343 and the second insulation layer 345 of the coaxial cable 34, so as to fix the connector 38 with the end of the coaxial cable 34. Afterwards, the fixing structure 48 of the connector 38 is to be disposed through the at least one hole 321 on the circuit board 32. In such a manner, the coaxial cable 34 can be fixed on the circuit board 32.

Furthermore, the first holding portion 42, the second holding portion 44 and the third holding portion 46 of the connector 38 has a first width D1, a second width D2 and a third width D3, respectively. In practical application, the second width D2 can be substantially identical to the width W2 of the exposed braid layer 343, and the third width D3 can be substantially identical to the width W3 of the exposed second insulation layer 345. Accordingly, the second holding portion 44 and the third holding portion 46 of the connector 38 are capable of holding the braid layer 343 and the second insulation layer 345 of the coaxial cable 34, respectively. In this embodiment, the first width D1 can be, but not limited to, identically to the second width D2. For example, the first width D1 of the first holding portion 42 can be greater than the second width D2 of the second holding portion 44. Alternatively, the first width D1 of the first holding portion 42 can be smaller than the second width D2 of the second holding portion 44. In other words, design of dimension of the first width D1 of the first holding portion 42 capable of holding the first insulation layer 341 of the coaxial cable 34 is within the scope of the present invention.

Furthermore, the fixing structure 48 of the connector 38 includes a first pin 481 and a second pin 483. The first pin 481 extends from the second end portion P2 of the main body 40 in the direction away from the second holding portion 44 and is located on a side S1 of the main body 40. The second pin 483 extends from the second end portion P2 of the main body 40 in the direction away from the second holding portion 44 and is located on another side S2 of the main body 40. The at least one hole 321 on the circuit board 32 includes a first through hole 3211, a second through hole 3213 and a third through hole 3215. The first through hole 3211, the second through hole 3213 and the third through hole 3215 correspond to the first pin 481 and the second pin 483 of the fixing structure 48 and the conductor 347 of the coaxial cable 34, respectively. When the fixing structure 48 of the connector 38 is disposed through the at least one hole 321 on the circuit board 32, the first pin 481 and the second pin 483 of the fixing structure 48 can be respectively disposed through the first through hole 3211 and the second through hole 3213, so as to fix the coaxial cable 34 and the connector 38 with the circuit board 32. In practical application, the first through hole 3211 and the second through hole 3213 can be respectively connected to a grounding (GND) of the circuit board 32. In other words, the first through hole 3211 and the second through hole 3213 can be respectively a grounding hole. Accordingly, the connector 38 can be connected to the grounding when the first pin 481 and the second pin 483 are respectively disposed through the first through hole 3211 and the second through hole 3213. In such a manner, noises on the braid layer 343 of the coaxial cable 34 can be vanished in accordance with being transmitted from the main body 40 of the connector 38 to the grounding of the circuit board 32, via the third holding portion 46, the first pin 481 and the second pin 483 in sequence. In addition, the conductor 347 of the coaxial cable 34 can be disposed through the third through hole 3215 when the first pin 481 and the second pin 483 are respectively disposed through the first through hole 3211 and the second through hole 3213. In such a manner, the radio frequency signal received by the electronic component, such as the antenna, which is connected to the female connector 36 can be transmitted to the circuit board 32 via the female connector 36 and the coaxial cable 34 in sequence. Alternatively, the signals generated by the circuit board 32 can be transmitted to the electronic component via the coaxial cable 34 and the female connector 36 in sequence, and then transmitted in a wireless manner by the electronic component. In such a manner, the transmission interface 30 of the present invention can communicate with other external electronic devices.

In practical application, the first pin 481 and the second pin 483 of the connector 38 and the conductor 347 of the coaxial cable 34 can be fixed on the circuit board 32 by using surface mounting technology (SMT), respectively. It should be noticed that a length L1 of the first pin 481, a length L2 of the second pin 483 and the width W1 of the conductor 347 can be substantially identical to the thickness T of the circuit board 32, respectively. As a result, when the first pin 481, the second pin 483 and the conductor 347 are respectively disposed through the first through hole 3211, the second through hole 3213 and the third through hole 3215, the first pin 481, the second pin 483 and the conductor 347 can be substantially aligned with a bottom surface of the circuit board 32 for facilitating the solder paste to be attached with the first pin 481, the second pin 483 and the conductor 347 during the process of the surface mounting technology.

Figure 5:
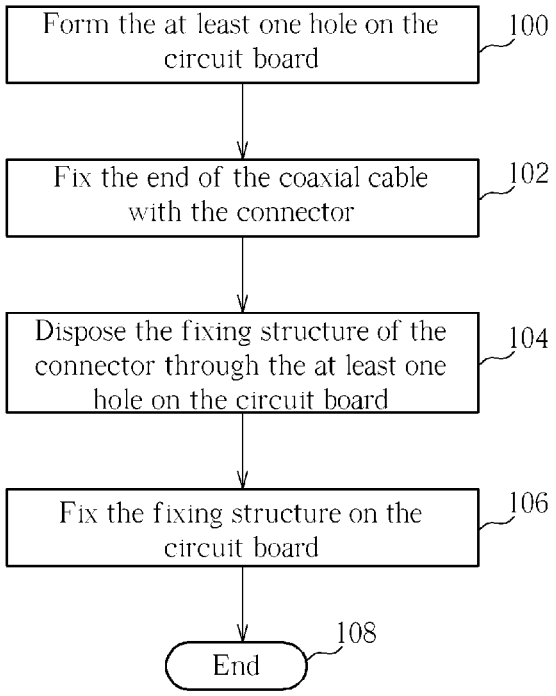
FIG. 5 is a flowchart of a method illustrating that the coaxial cable 34 is assembled with a circuit board by a connector according to the embodiment of the present invention.

Please refer to FIG. 5. FIG. 5 is a flowchart of a method illustrating that the coaxial cable 34 is assembled with the circuit board 32 by the connector 38 according to the embodiment of the present invention. The method includes following steps:

Step 100: Form the at least one hole 321 on the circuit board 32.

Step 102: Fix the end of the coaxial cable 34 with the connector 38.

Step 104: Dispose the fixing structure 48 of the connector 38 through the at least one hole 321 on the circuit board 32.

Step 106: Fix the fixing structure 48 on the circuit board 32.

Step 108: End.

More detailed description of the aforesaid steps is provided as follows. In Step 100, the at least one hole 321 is formed on the circuit board 32 in advance. In this embodiment, the first through hole 3211, the second through hole 3213 and the third through hole 3215 are formed on the circuit board 32. Then, the end of the coaxial cable 34 is fixed with the connector 38 in a crimping manner. In this embodiment, the first holding portion 42 of the connector 38 is used for holding the first insulation layer 341 of the coaxial cable 34, the second holding portion 44 of the connector 38 is used for holding the braid layer 343 of the coaxial cable 34, and the third holding portion 46 of the connector 38 is used for holding the second insulation layer 345 of the coaxial cable 34 (Step 102). Afterwards, the fixing structure 48 of the connector 38 is disposed through the at least one hole 321 on the circuit board 32. In this embodiment, the first pin 481 and the second pin 483 of the fixing structure 48 are respectively disposed through the first through hole 3211 and the second through hole 3213. In the meanwhile, the conductor 347 of the coaxial cable 34 is disposed through the third through hole 3215 (Step 104). Finally, the fixing structure 48 is fixed on the circuit board 32. In this embodiment, the first pin 481, the second pin 483 and the conductor 347 of the coaxial cable 34 can be fixed on the circuit board 32 by using the surface mounting technology (Step 108), and the assembly process of the coaxial cable 34 and the circuit board 32 is done (Step 108).

In this embodiment, the assembly sequence of the circuit board 32, the coaxial cable 34 and the connector 38 is that the fixing structure 48 of the connector 38 is disposed through the at least one hole 321 on the circuit board 32 after the end of the coaxial cable 34 is fixed with the connector 38. In other words, Step 104 is executed after Step 102. However, the assembly sequence of the circuit board 32, the coaxial cable 34 and the connector 38 is not limited to that mentioned above. For example, the end of the coaxial cable 34 can be fixed with the connector 38 in a manual manner after the fixing structure 48 of the connector 38 is disposed through the at least one hole 321 on the circuit board 32 in another embodiment. In other words, Step 102 is executed after Step 104. Furthermore, after the fixing structure 48 of the connector 38 is disposed through the at least one hole 321 on the circuit board 32, the first holding portion 42, the second holding portion 44 and the third holding portion 46 of the connector 38 can be respectively to hold on the first insulation layer 341, the braid layer 343 and the second insulation layer 345 of the coaxial cable 34, so as to fix the connector 38 with the coaxial cable 34.

Figure 6:
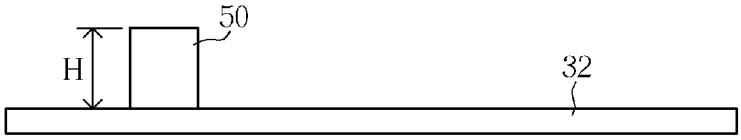
FIG. 6 is a side view of a jig and the circuit board according to an embodiment of the present invention.
Figure 7:
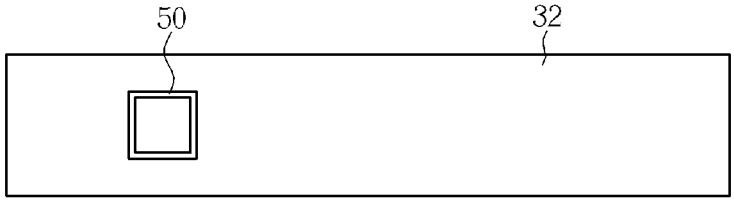
FIG. 7 is a top view of the jig and the circuit board in FIG. 6.

Please refer to FIG. 6 and FIG. 7. FIG. 6 is a side view of a jig 50 and the circuit board 32 according to an embodiment of the present invention. FIG. 7 is a top view of the jig 50 and the circuit board 32 in FIG. 6. As shown in FIG. 6 and FIG. 7, the jig 50 can be a hollow post structure. When executing Step 106, the jig 50 can be disposed in a position where the connector 38 is fixed on the circuit board 32 in order to keep the first pin 481 and the second pin 483 of the connector 38 and the conductor 347 of the coaxial cable 34 in balance on the circuit board 32 without being slanting when the surface mounting process is implemented. Accordingly, the jig 50 can support the connector 38 and prevent the connector 38 from being slanting relative to the circuit board 32. In addition, the jig 50 has a height H. As a result, the jig 50 can support the connector 38 for the part of the connector 38 with a height under the height H, so as to enhance supporting effect for the connector 38.

Figure 8:
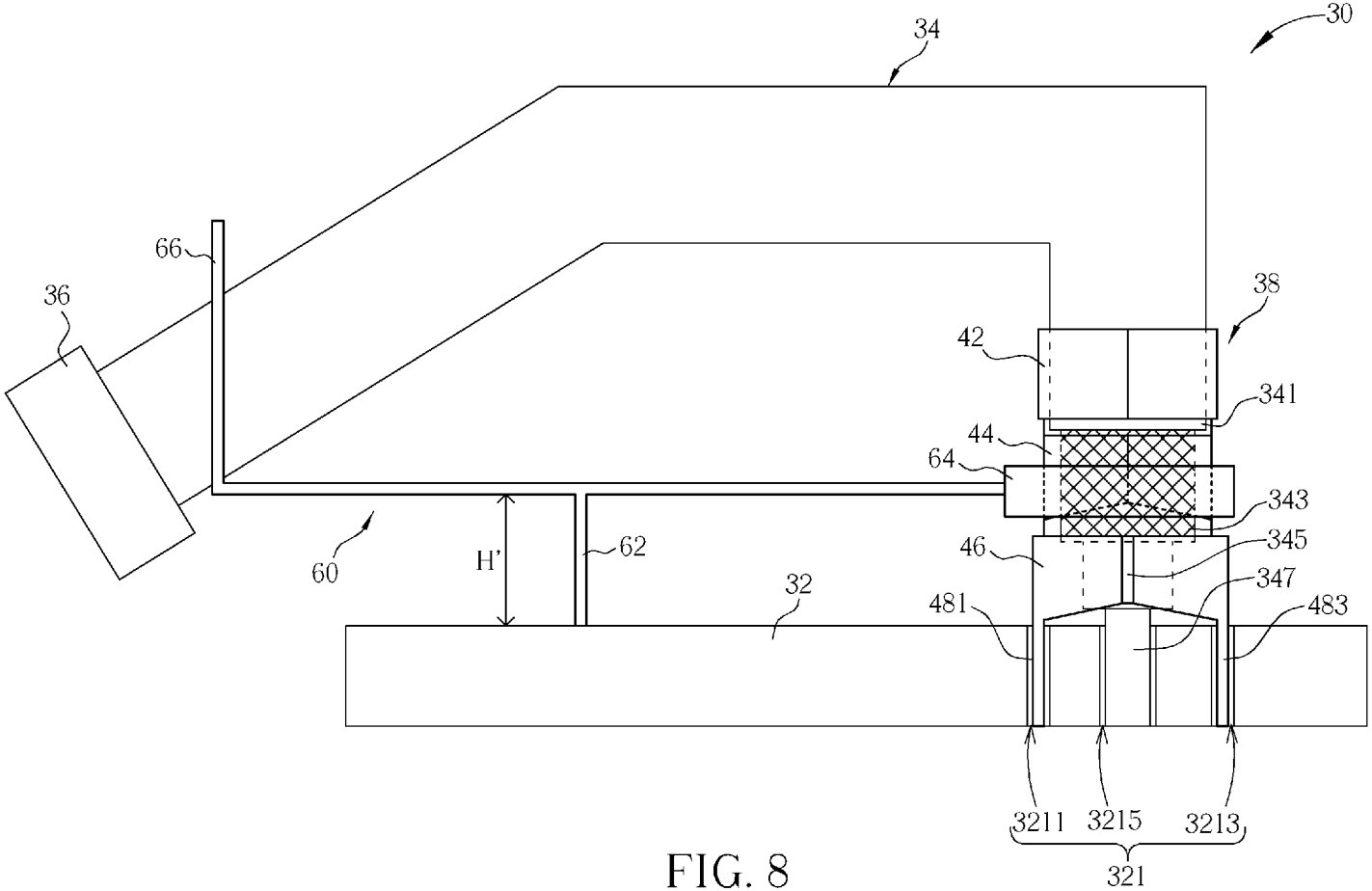
FIG. 8 is a side view of a jig and the transmission interface according to another embodiment of the present invention.
Figure 9:
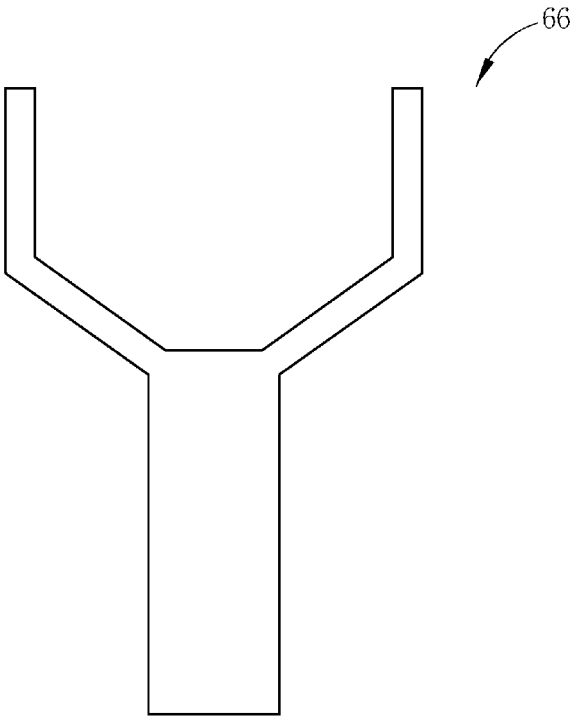
FIG. 9 is a diagram of a second fixing portion of the jig in another view according to another embodiment of the present invention.

Please refer to FIG. 8. FIG. 8 is a side view of a jig 60 and the transmission interface 30 according to another embodiment of the present invention. As shown in FIG. 8, the jig 60 has a supporting portion 62, a first fixing portion 64 and a second fixing portion 66. The supporting portion 62 is disposed near a position where the connector 38 is fixed on the circuit board 32. The first fixing portion 64 is used for fixing the connector 38 and the coaxial cable 34, and the second fixing portion 66 is used for fixing another end of the coaxial cable 34 and the female connector 36. Please refer to FIG. 9. FIG. 9 is a diagram of the second fixing portion 66 of the jig 60 in another view according to another embodiment of the present invention. As shown in FIG. 9, the second fixing portion 66 can be a Y-shaped structure with a recess portion for holding the other end of the coaxial cable 34, so as to fix the other end of the coaxial cable 34 with the female connector 36. In addition, the jig 60 has a height H'. As a result, the jig 60 can support the connector 38 for the part of the connector 38 with a height under the height H', so as to enhance supporting effect for the connector 38.

In contrast to the prior art, the present invention utilizes the first holding portion, the second holding portion and the third holding portion to respectively hold the first insulation layer, the braid layer and the second insulation layer of the coaxial cable, so as to fix the connector with the end of the coaxial cable. Furthermore, the first pin and the second pin of the connector as well as the conductor of the coaxial cable can be respectively disposed through the first through hole, the second through hole and the third through hole on the circuit board, and then the first pin, the second pin and the conductor can be fixed on the circuit board by using surface mounting technology. In such a manner, the present invention can utilize a single connector to connect the coaxial cable on the circuit board, so as to decrease material cost of manufacture. In addition, when the coaxial cable is fixed with the circuit board by the connector, the end of the coaxial cable is to be fixed with the connector after the fixing structure of the connector is disposed through the at least one hole on the circuit board. Alternatively, the fixing structure of the connector also can be disposed through the at least one hole on the circuit board after the end of the coaxial cable is fixed with the connector. Since the connector is capable of assembling with the coaxial cable and the circuit board simultaneously, it facilitates to save extra labors for assembly and results in decrease of manufacture cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector for connecting a coaxial cable and a circuit board, comprising:

a main body;

a first holding portion extending from a first end portion of the main body for holding a first insulation layer of the coaxial cable;

a second holding portion extending from the main body in a position located between a second end portion opposite to the first end portion and the first holding portion for holding a braid layer of the coaxial cable;

a third holding portion extending from the second end portion of the main body for holding a second insulation layer of the coaxial cable; and a fixing structure extending from the second end portion of the main body in a direction away from the second holding portion for disposing through at least one hole on the circuit board, so as to fix the coaxial cable on the circuit board.

2. The connector of claim 1, wherein the fixing structure comprises:

a first pin extending in the direction away from the second holding portion and located on a side of the main body; and a second pin extending in the direction away from the second holding portion and located on another side of the main body, the at least one hole on the circuit board comprising a first through hole and a second through hole, and the first pin and the second pin being respectively disposed through the first through hole and the second through hole on the circuit board, so as to fix the coaxial cable on the circuit board.

3. The connector of claim 1, wherein the first holding portion has a first width, the second holding portion has a second width, and the second width is substantially identical to a width of the braid layer.

4. The connector of claim 3, wherein the first width is substantially identical to the second width.

5. The connector of claim 3, wherein the third holding portion has a third width, and the third width is substantially identical to a width of the second insulation layer.

6. A transmission interface, comprising:

a circuit board whereon at least one hole is formed;

a coaxial cable disposed on the circuit board, comprising a first insulation layer, a braid layer, a second insulation layer and a conductor;

a female connector connected to an end of the coaxial cable; and a connector connected to another end of the coaxial cable, the connector comprising:

a main body;

a first holding portion extending from a first end portion of the main body for holding the first insulation layer of the coaxial cable;

a second holding portion extending from the main body in a position located between a second end portion opposite to the first end portion and the first holding portion for holding the braid layer of the coaxial cable;

a third holding portion extending from the second end portion of the main body for holding the second insulation layer of the coaxial cable; and a fixing structure extending from the second end portion of the main body in a direction away from the second holding portion for disposing through the at least one hole on the circuit board, so as to fix the coaxial cable on the circuit board.

7. The transmission interface of claim 6, wherein the at least one hole on the circuit board comprises a first through hole and a second through hole, and the fixing structure comprises:

a first pin extending in the direction away from the second holding portion and located on a side of the main body; and a second pin extending in the direction away from the second holding portion and located on another side of the main body, the first pin and the second pin being respectively disposed through a first through hole and a second through hole on the circuit board, so as to fix the coaxial cable on the circuit board.

8. The transmission interface of claim 7, wherein a third hole is formed on the circuit board, and the conductor of the coaxial cable is disposed through the third through hole when the first pin and the second pin respectively dispose through the first through hole and the second through hole.

9. The transmission interface of claim 6, wherein the first holding portion has a first width, the second holding portion has a second width, and the second width is substantially identical to a width of the braid layer.

10. The transmission interface of claim 9, wherein the first width is substantially identical to the second width.

11. The transmission interface of claim 9, wherein the third holding portion has a third width, and the third width is substantially identical to a width of the second insulation layer.

12. A method for assembling a coaxial cable on a circuit board by a connector, comprising:

forming at least one hole on the circuit board;

fixing an end of the coaxial cable with the connector, comprising:

utilizing a first holding portion extending from a main body of the connector to hold a first insulation layer of the coaxial cable;

utilizing a second holding portion extending from the main body of the connector to hold a braid layer of the coaxial cable; and utilizing a third holding portion extending from the main body of the connector to hold a second insulation layer of the coaxial cable;

disposing a fixing structure of the connector through the at least one hole on the circuit board; and fixing the fixing structure on the circuit board.

13. The method of claim 12, wherein the fixing structure of the connector is disposed through the at least one hole on the circuit board after the end of the coaxial cable is fixed with the connector.

14. The method of claim 12, wherein the end of the coaxial cable is fixed with the connector after the fixing structure of the connector is disposed through the at least one hole on the circuit board.

15. The method of claim 12, wherein forming the at least one hole on the circuit board comprises forming a first through hole and a second through hole on the circuit board, and disposing the fixing structure of the connector through the at least one hole on the circuit board comprises disposing a first pin and a second pin of the fixing structure through the first through hole and the second through hole, respectively.

16. The method of claim 15, wherein fixing the fixing structure on the circuit board comprises fixing the first pin and the second pin on the circuit board by using surface mounting technology (SMT), respectively.

17. The method of claim 15, wherein forming the at least one hole on the circuit board further comprises forming a third through hole on the circuit board, and the method further comprises disposing a conductor of the coaxial cable through the third through hole.

18. The method of claim 17, further comprising disposing the conductor of the coaxial cable through the third through hole using surface mounting technology.

* * * * *